US007901542B2

(12) United States Patent
Koyamoto et al.

(10) Patent No.: US 7,901,542 B2
(45) Date of Patent: Mar. 8, 2011

(54) COATED PAPERS FOR NEWSPRINT INKS AND PROCESSES FOR PREPARING THEM

(75) Inventors: Hiroshi Koyamoto, Tokyo (JP); Koji Okomori, Tokyo (JP); Masahito Suzuki, Tokyo (JP); Hirokazu Morii, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 900 days.

(21) Appl. No.: 10/584,347

(22) PCT Filed: Dec. 27, 2004

(86) PCT No.: PCT/JP2004/019540

§ 371 (c)(1),
(2), (4) Date: May 24, 2007

(87) PCT Pub. No.: WO2005/064079

PCT Pub. Date: Jul. 14, 2005

(65) Prior Publication Data

US 2007/0240838 A1 Oct. 18, 2007

(30) Foreign Application Priority Data

Dec. 26, 2003 (JP) ..... 2003-432302

(51) Int. Cl.
*D21H 19/38* (2006.01)

(52) U.S. Cl. ..... 162/135; 162/158; 162/168.1; 162/179; 162/181.1; 428/341; 428/195.1; 428/32.34; 427/391

(58) Field of Classification Search ..... 162/135–136, 162/158, 181.1, 181.2, 179, 164.1, 164.3, 162/168.1; 428/340–341, 195.1, 32.34; 427/358, 361, 391
See application file for complete search history.

(56) References Cited

U.S. PATENT DOCUMENTS 4,154,899 A 5/1979 Hershey et al.
4,490,732 A 12/1984 Maekawa et al.

(Continued)

FOREIGN PATENT DOCUMENTS

EP 0 377 983 7/1990

(Continued)

OTHER PUBLICATIONS

Enomae et al., "Characteristics of Parker Print-Surf roughness as compared with Bekk smoothness," 1997, pp. 1-26.*

(Continued)

*Primary Examiner* — José A Fortuna
(74) *Attorney, Agent, or Firm* — Roylance, Abrams, Berdo & Goodman, L.L.P.

(57) ABSTRACT

The present invention aims to provide coated papers for newsprint inks having fast ink drying properties comparable to those of conventional newsprint papers, without stickiness, and having good reproduction and sharpness of printed images comparable to those of coated papers printed using penetration drying type inks; as well as processes for preparing them. The invention provides for a coated printing paper for newsprint inks comprising a coating layer containing a pigment and an adhesive on a base paper, characterized in that the coating layer on the base paper has a coat weight of 4.0 g/m$^2$ or more per side and that the coated paper has an oil absorbency under pressure of 20 g/m$^2$ or more and a Bekk smoothness of 75 seconds or less; as well as a process for preparing the paper.

5 Claims, 1 Drawing Sheet

U.S. PATENT DOCUMENTS

| | | | | |
|---|---|---|---|---|
| 4,542,059 | A | 9/1985 | Toganoh et al. | |
| 4,749,678 | A | 6/1988 | Tamagawa et al. | |
| 5,376,237 | A * | 12/1994 | Ishiguro et al. | 162/134 |
| 5,753,077 | A * | 5/1998 | Horand et al. | 162/135 |
| 5,952,091 | A | 9/1999 | Horand et al. | |
| 6,391,155 | B1 * | 5/2002 | Wurster et al. | 162/135 |
| 6,413,370 | B1 | 7/2002 | Wurster et al. | |
| 6,547,929 | B2 * | 4/2003 | Bobsein et al. | 162/135 |
| 6,572,951 | B2 * | 6/2003 | Hasegawa et al. | 428/141 |
| 6,863,775 | B2 * | 3/2005 | Bobsein et al. | 162/135 |
| 6,899,921 | B2 * | 5/2005 | Haenen et al. | 427/337 |
| 7,101,459 | B2 * | 9/2006 | Nisogi et al. | 162/135 |
| 7,575,802 | B2 * | 8/2009 | Chatani et al. | 428/341 |
| 2002/0014318 | A1 * | 2/2002 | Bobsein et al. | 162/135 |
| 2003/0124372 | A1 * | 7/2003 | Haenen et al. | 428/537.5 |
| 2003/0178165 | A1 * | 9/2003 | Bobsein et al. | 162/135 |
| 2004/0045686 | A1 * | 3/2004 | Nisogi et al. | 162/135 |
| 2005/0016701 | A1 * | 1/2005 | Nisogi et al. | 162/135 |
| 2006/0137841 | A1 * | 6/2006 | Chatani et al. | 162/135 |
| 2007/0221349 | A1 * | 9/2007 | Ohira et al. | 162/137 |
| 2007/0240838 | A1 * | 10/2007 | Koyamoto et al. | 162/134 |
| 2009/0162641 | A1 * | 6/2009 | Koyamoto et al. | 428/328 |
| 2009/0162642 | A1 * | 6/2009 | Ono et al. | 428/330 |

FOREIGN PATENT DOCUMENTS

| | | | |
|---|---|---|---|
| EP | 0648894 | | 4/1995 |
| EP | 0785307 | | 7/1997 |
| EP | 0930394 | | 7/1999 |
| EP | 1001082 | A1 * | 5/2000 |
| EP | 1016755 | A2 * | 7/2000 |
| EP | 1700952 | A1 * | 9/2006 |
| JP | 58-069091 | | 4/1983 |
| JP | 61089888 | A * | 5/1986 |
| JP | 11-286894 | | 10/1999 |
| JP | 2003-286686 | | 10/2003 |
| WO | WO 2005064079 | A1 * | 7/2005 |
| WO | WO 2007069683 | A1 * | 6/2007 |
| WO | WO 2007086497 | A1 * | 8/2007 |

OTHER PUBLICATIONS

Database WPI Week 200421, Thomson Scientific, London, GB; AN XP002580424 “Fine Coating Newsprint Paper”.

* cited by examiner

COATED PAPERS FOR NEWSPRINT INKS AND PROCESSES FOR PREPARING THEM

TECHNICAL FIELD

The present invention relates to coated papers for newsprint inks having good printability and good color print quality, as well as processes for preparing them.

BACKGROUND ART

Recently, with the growth of various printing technologies there is a growing trend in employing multicolor printing and using printing press with greatly improved printing speed. This tendency is also seen in newspaper printing. Multicolor printing of newsprint takes place under conventional printing conditions, i.e. penetration drying type inks are used for printing on conventional newsprint by high-speed coldset rotary presses to meet the need for immediate mass printing typical of newspaper printing and for cost-related reasons.

However, multicolor prints obtained under conventional newspaper printing conditions were very poor in color or sharpness as compared with conventional printing coated papers and as a result lacked visual appeal.

Therefore, newspaper pages requiring especially high final print quality such as color pages for multicolor advertising in newspapers or newspaper inserts are printed separately on coated printing papers or the like by conventional heatset rotary presses instead of high-speed coldset rotary presses. Under the present circumstances, the use of coldset rotary presses is stopped in newspaper publishing. This means that penetration drying type inks and high-speed coldset rotary presses as used in conventional newspaper printing are not practical to use with normal coated printing papers having a pigment coating layer on woodfree or wood-containing paper because the inks fail to dry when printing by coldset rotary presses, i.e., without using a post-dryer. However, printing effect is enhanced if printing were performed at low speed. Even if a pigment coating layer is provided on current newsprint, multicolor prints with good final quality cannot be obtained by applying penetration drying type inks when using high-speed coldset rotary presses because ink drying properties are very poor as in the case where a pigment coating layer is provided on normal uncoated paper.

A possible approach for improving print quality is to replace penetration drying type inks by heatset printing inks and switch from coldset rotary presses to heatset printers having dryer equipment for printing on newsprint. This approach has the disadvantages that equipment costs are high and printing costs thereby increase.

For these reasons, there have been strong demands for papers that satisfy the requirements of printability and beautiful multicolor prints using high-speed coldset rotary printing with penetration drying type newsprint inks.

For example, a newsprint having a coating layer containing a pigment having an oil absorbency of 65 cc/100 g or more was proposed (see patent document 1). However, the coating layer containing a pigment having high oil absorbency transfers much printing ink so that the amount of printing ink required increases, whereby ink drying is retarded and the problem of stickiness sometimes occurred in multicolor printing. A coated newsprint having high ink drying capability and ink density by defining dynamic wetting of the base paper and combining kaolin and a pigment having a defined average particle diameter was proposed (see patent document 2), but ink drying was retarded and the problem of stickiness sometimes occurred in multicolor printing. A slightly coated newsprint having 1.0 g/m$^2$ or more and 4.0 g/m$^2$ or less of a coating layer on a base paper and a moisture in paper of 4.5% or less was proposed (see patent document 3). However, color printed images were poor in tone reproduction and sharpness and insufficient in image quality or the like, and disadvantages such as stickiness occurred if the coat weight increased in multicolor printing.

Under these circumstances, there have been strong demands for coated papers for newsprint inks having high printability by eliminating stickiness without retarding ink drying and having good printability such as color reproduction and sharpness when printing using penetration drying type inks, especially when printing with high-speed coldset rotary presses using penetration drying type inks.

References:

Patent document 1: JPA HEI 1-174697.
Patent document 2: JPA HEI 4-57988.
Patent document 3: JPA 2003-286686.

DISCLOSURE OF THE INVENTION

Problems to be Solved by the Invention

In view of these circumstances, an object of the present invention is to provide a coated paper for newsprint inks having fast ink drying properties comparable to those of conventional newsprint papers, without stickiness and having sharpness or other properties of printed images comparable to those of coated papers when printing using penetration drying type newsprint inks.

Means to Solve the Problems

As a result of careful studies to achieve the above object, we attained the present invention on the basis of the finding that it is possible to obtain coated paper for newsprint inks having good ink drying properties, little stickiness, good printability, and good reproduction and sharpness. The above object can be achieved by preparing a coated printing paper comprising a coating layer containing a pigment and an adhesive on a base paper wherein the coating layer on the base paper has a coat weight of 4.0 g/m$^2$ or more per side and the coated paper has an oil absorbency under pressure of 20 g/m$^2$ or more and a Bekk smoothness of 75 seconds or less.

The present invention also provides a method for determining oil absorbency under pressure of a coated paper for newsprint inks, comprising placing a paper sample in a sealable cup having a membrane filter at the bottom in such a manner that it comes into close contact with the lower face of the membrane filter, placing a fluid impermeable mat in close contact with the lower face of the paper sample, then injecting an oil into the cup, maintaining a sealed space formed by the fluid impermeable mat and the cup at a given pressure (50 kPa) for a given period (20 seconds) to allow the paper sample to absorb the oil injected into the cup through the membrane filter, then releasing the pressure and measuring the amount of oil absorbed by the paper under pressure. The fluid impermeable mat can be made from rubber. The membrane filter can be made from any material that does not absorb oil to avoid measurement errors and has strength capable of enduring the test pressure, but preferably a polycarbonate.

The reason why the advantages of the present invention are obtained by selecting each value within the specific range described above may be explained as follows.

In the present invention, it is important to find a balance between printability such as stickiness or stain on the print surface and print quality such as ink receptivity or print sharpness by providing 4.0 g/m$^2$ per side or more of a coating layer on a base paper and controlling the oil absorbency under pressure and Bekk smoothness to ensure high color printability when newsprint inks are used.

In the present invention, the method for determining the oil absorbency under pressure uses AA-GWR Water Retention Meter from KALTEC. A paper sample to be tested, a membrane filter (from KALTEC; made from polycarbonate; pore size 5.0 μm; thickness 300 μm), and the supplied cup are placed in the instrument, and 1 ml of soybean oil is added from the top, and then the cup is sealed and pressurized at a given pressure (50 kPa) for a given period (20 seconds), and then the amount of oil is measured.

Normally, the oil drop absorbency measured at normal pressures is typically used to evaluate ink drying properties, i.e., the oil absorbency of papers. However, the oil drop absorbency measured at normal pressures did not reflect actual printing conditions and showed no definite correlation with printability such as paper surface stain or stickiness because inks on the blanket in offset rotary presses are practically applied on paper under pressure between upper and lower cylinders. A method for testing oil absorbency under pressure is defined in JIS P 8130, but this method also lacked correlation with printability. After searching for a novel method for evaluating oil absorbency, we found the method described above, which shows correlation with printability. If the oil absorbency under pressure is less than 20 g/m$^2$, newsprint inks are less likely to penetrate the coated paper during printing, which deteriorates ink receptivity on the surface of the coated paper and retards ink drying, resulting in stickiness or stains on the print surface. If the oil absorbency under pressure is too high, inks excessively penetrate the coated paper, which tends to decrease ink receptivity and deteriorate reproduction and sharpness of prints. Coated papers having an oil absorbency under pressure of preferably 25 g/m$^2$ or more and 250 g/m$^2$ or less, more preferably 30 g/m$^2$ or more and 160 g/m$^2$ or less are obtained by controlling the coat weight, using a fine coating pigment, controlling the content of binders, adding mechanical pulp, adding an organic compound having the action of inhibiting interfiber bonding of pulp, reducing the linear load of calendering or other such means.

Beck smoothness is an important indication for controlling stickiness, paper surface stain or the like of prints. If the Bekk smoothness is more than 75 seconds, printability deteriorates because of serious paper surface stain. This is probably because inks supplied to the surfaces of papers having low smoothness are less likely to be transferred during printing in contrast to papers having high smoothness in which inks once transferred to the papers may be retransferred to rolls of presses or the like, thus causing paper surface stain. More preferably, Bekk smoothness is 10 seconds or more and 60 seconds or less. Methods for regulating Bekk smoothness at 75 seconds or less include controlling the proportion of mechanical pulp, adding an organic compound having the action of inhibiting interfiber bonding of pulp, using a pigment with little contribution to smoothness, controlling the coat weight, reducing the linear load of calendering, etc.

In the present invention, oil absorbency under pressure and smoothness are balanced in papers. That is, it is thought that coated papers with little stickiness and paper surface stain in prints and high printing sharpness were obtained by defining oil absorbency under pressure and smoothness within the specific ranges indicated above and applying the coat weight of 4.0 g/m$^2$ or more.

Oil absorbency under pressure and Bekk smoothness can be included within the specific ranges indicated above by controlling the proportion of mechanical pulp, adding an organic compound having the action of inhibiting interfiber bonding of pulp, using a pigment with little contribution to smoothness, or controlling the coat weight of the pigment coating layer in the coating layer, coating conditions or the type and conditions of calendering, etc. alone or in combination.

In the present invention, print qualities such as ink drying properties and ink receptivity when using newsprint inks are improved by including 30 parts by weight or more, more preferably 50 parts by weight or more of calcium carbonate per 100 parts by weight of pigments. Moreover, the density is reduced and oil absorbency, ink drying properties and print qualities are improved by including an organic compound having the action of inhibiting interfiber bonding of pulp in the base paper.

Advantages of the Invention

The present invention made it possible to obtain coated papers for newsprint inks having fast ink drying properties comparable to those of conventional newsprint, without stickiness, having good reproduction and sharpness of printed images comparable to those of coated papers printed using penetration drying type inks.

PREFERRED EMBODIMENTS OF THE INVENTION

Figure 1:
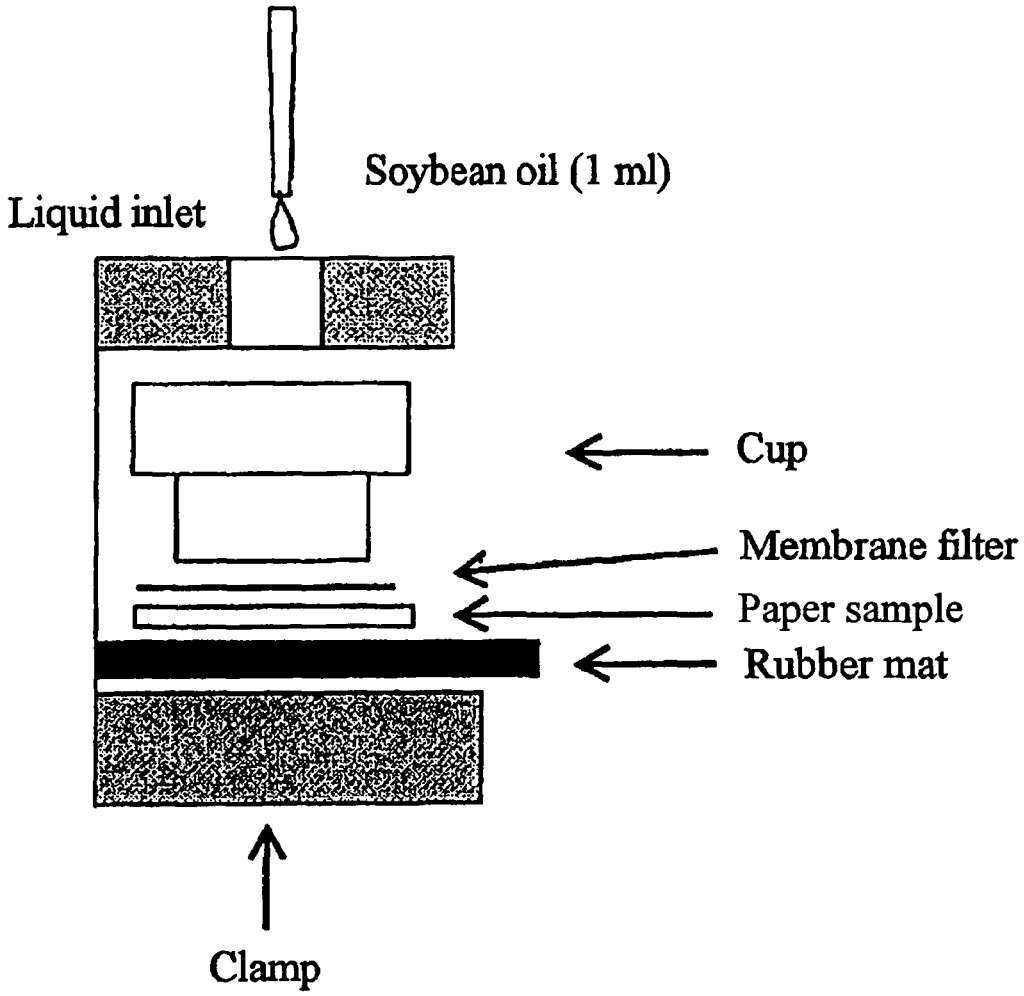
FIG. 1 is a schematic diagram showing an apparatus (AA-GWR) used in the method for determining oil absorbency under pressure of papers.

Pulps contained in the base paper include chemical pulps (e.g., bleached or unbleached softwood kraft pulps, bleached or unbleached hardwood kraft pulps, etc.); mechanical pulps (e.g., groundwood pulps, thermomechanical pulps, chemithermomechanical pulps, etc.); and deinked pulps (e.g., recovered paper pulps); and these can be used alone or in admixture at any ratio. In the present invention, mechanical pulp is preferably contained in the base paper at 10% by weight or more, more preferably 30% by weight or more because mechanical pulps are bulkier and more oil absorbent than chemical and deinked pulps. The types of fillers contained in the base paper can be known fillers such as hydrated silica, white carbon, talc, kaolin, clay, calcium carbonate, titanium oxide, synthetic resin fillers, etc. Optionally, aluminum sulfate, sizing agents, paper strength additives, retention aid, colorants, dyes, antifoaming agents or the like may further be contained, if desired. In the present invention, the base paper preferably contains an organic compound having the action of inhibiting interfiber bonding of pulp to reduce the density of the base paper layer and to balance oil absorbency and smoothness.

Suitable pulp bonding inhibitors contained in the present invention are density reducing agents (or bulking agents) recently introduced in the market to increase the bulk of papers for papermaking purposes, including for e.g., compounds disclosed in WO98/03730, JPA HEI 11-200284, JPA HEI 11-350380, JPA 2003-96694, JPA 2003-96695, etc. Specifically, ethylene and/or propylene oxide adducts of higher alcohols, polyvalent alcohol-type nonionic surfactants, ethylene oxide adducts of higher fatty acids, ester compounds of polyvalent alcohols and fatty acids, ethylene oxide adducts of ester compounds of polyvalent alcohols and fatty acids, or fatty acid polyamide amines, fatty acid diamide amines, fatty acid monoamides, or condensation products of polyalkylene polyamine/fatty acid/epichlorohydrin or the like can be used alone or in combination of two or more. Preferred are ester compounds of polyvalent alcohols and fatty acids; fatty acid amide compounds such as fatty acid diamide amines, fatty acid monoamides; and condensation products of polyalkylene polyamine/fatty acid/epichlorohydrin. Commercially available bulking agents include Sursol VL from BASF; Bayvolume P Liquid from Bayer; KB-08T, 08W, KB-110, -115 from Kao Corporation; Reactopaque from Sansho Co., Ltd.; PT-205 from Japan PMC Corporation; DZ2220, DU3605 from NOF Corporation; R21001 from Arakawa Chemical industries, Ltd., and these can be used alone or in combination of two or more. Coated papers of the present invention preferably contain 0.1-10 parts by weight, especially 0.2-1.0 parts by weight of the inhibitors of interfiber bonding of pulp per 100 parts by weight of pulp to improve air permeability of the base paper.

Pigments used in the coating layer of the present invention are those conventionally used for papermaking including inorganic pigments such as kaolin, clay, ground calcium carbonate, precipitated calcium carbonate, talc, titanium dioxide, barium sulfate, calcium sulfate, zinc oxide, silicic acid, silicic acid salts, colloidal silica and satin white; and organic pigments such as plastic pigments; and these pigments can be used alone or in combination of two or more. In the present invention, it is preferable to use a pigment with little contribution to smoothness having an aspect ratio of 10 or less, more preferably 5 or less. Print qualities such as ink drying properties are improved by including 30 parts by weight or more, more preferably 50 parts by weight or more of calcium carbonate having a cumulative proportion of 70% or more of particles having a particle diameter of 2 μm or less, more preferably ground calcium carbonate per 100 parts by weight of pigments.

Adhesives used in the present invention can be selected as appropriate from one or more of conventional adhesives for coated papers, e.g., synthetic adhesives such as styrene-butadiene copolymers, styrene-acrylic copolymers, ethylene-vinyl acetate copolymers, butadiene-methyl methacrylate copolymers, vinyl acetate-butyl acrylate copolymers, or polyvinyl alcohols, maleic anhydride copolymers and acrylic-methyl methacrylate copolymers; proteins such as casein, soybean protein and synthetic proteins; starches such as oxidized starches, cationized starches, urea phosphate-esterified starches, hydroxyethyl etherified starches or other etherified starches, dextrin; and cellulose derivatives such as carboxymethyl cellulose, hydroxymethyl cellulose, hydroxyethyl cellulose. These adhesives are preferably used in a range of 5-50 parts by weight, more preferably 10-30 parts by weight per 100 parts by weight of pigments. If the content of the adhesives is less than 5 parts by weight, surface strength tends to decrease, but if it exceeds 50 parts by weight, ink drying is retarded and the problem of stickiness tends to occur.

In the present invention, a starch is preferably included as an adhesive in an amount of 3 parts by weight or more, more preferably 5 parts by weight or more per 100 parts by weight of pigments. Coated-papers of the present invention preferably have low density, and therefore, low-density base papers should be coated. Low-density base papers are porous so that coatings normally tend to penetrate the base papers, thereby deteriorating the coverage of the base papers. Thus, the coverage by the coating layer is improved by including 3 parts by weight or more of a starch having a better water-retention capacity as compared with binders such as latex. An alternative effective means for improving water-retention capacity is to include various natural or synthetic water retention agents.

The coating color of the present invention may contain various conventional additives such as dispersants, thickeners, water retention agents, antifoaming agents, insolubilizers, etc.

The base paper to be coated in the present invention has a basis weight of about 30-100 g/m$^2$ because it is used for coated papers for newsprint inks, especially coated papers for rotary presses for newspapers, though base papers used for normal coated papers have a basis weight of about 30-300 g/m$^2$. The process for preparing the base paper is not specifically limited, and the base paper may be prepared by any process for making acidic, neutral or alkaline papers using for e.g., a Fourdrinier paper machine including a top wire or the like, a cylinder paper machine, a board machine combining both a fourdrinier paper machine and a cylinder paper machine or a Yankee dryer machine or the like. Base papers precoated with starch or polyvinyl alcohol using a size press, bill blade, gate roll coater, premetering size press or the like or base papers precoated with one or more layers of a coating color containing a pigment and an adhesive can also be used. The base papers must have physical properties that allow printing with high-speed coldest rotary presses using penetration drying type inks, and may be those having physical strength such as tensile strength, tearing strength or elongation comparable to those of normal newsprint.

The coating color prepared is applied in one or more layers on the base paper on one side after the other or both sides simultaneously using a blade coater, bar coater, roll coater, air knife coater, reverse roll coater, curtain coater, size press coater, gate roll coater or the like. The coat weight per side of the base paper is 4 g/m$^2$ or more, preferably more than 4.0 g/m$^2$ and 12.0 g/m$^2$ or less, more preferably 4.5 g/m$^2$ or more and 8.0 g/m$^2$ or less per side.

The wet coating layer is dried by using various types of dryers such as steam heated cylinders, hot air dryers, gas heater dryers, electric heater dryers, infrared heater dryers, radio frequency heater dryers or the like, alone or in combination.

Preferably, thus dried coated paper is finally smoothed in a machine calender, supercalender, hot soft nip calender or the like, but it can be treated in any calender or uncalendered so far as a coated paper of a desired quality can be obtained.

Preferably, thus dried coated paper is finally smoothed in a machine calender, supercalender, soft nip calender, hot soft nip calender or the like, more preferably under mild calendering conditions, especially 100 kg/cm or less. However, it can be treated in any calender or uncalendered so far as a coated paper of a desired quality can be obtained.

EXAMPLES

The following examples further illustrate the present invention without, however, limiting the invention thereto as a matter of course. Unless otherwise specified, parts and % in the examples mean parts by weight and % by weight, respectively. Coating colors and the resulting newsprint for offset printing were tested by the following evaluation methods.

<Evaluation Methods>

(1) Oil absorbency under pressure: The oil absorbency under pressure as defined herein was determined using AA-GWR Water Retention Meter from KALTEC (see the schematic diagram shown in FIG. 1). First, six pieces of a paper sample to be tested (5 cm×5 cm) (or any number of pieces adjusted as appropriate if the sample is highly oil-absorbent) and a piece of a membrane filter (from KALTEC; pore size 5.0 μm) are laid on the supplied rubber mat and the supplied cup is placed thereon, and the assembly is inserted into the instrument. The assembly is raised by the clamp to come into close contact with the ceiling of the instrument, and then 1 ml of soybean oil (from Wako Pure Chemical Industries, Ltd., Wako first-class quality) is injected via the liquid inlet at the top, and immediately the supplied cap is put on the cup to seal it, after which the pressure in the cup is maintained at 50 kPa for 20 seconds and then released and the weight of the paper sample is measured. The test area is 8 $cm^2$. The weight gain corresponds to the weight of soybean oil absorbed by each paper under pressure and the weight of oil absorbed per $m^2$ is determined as oil absorbency under pressure herein.

Oil absorbency under pressure [$g/m^2$]=(paper weight after measurement [g]−paper weight before measurement [g])/(0.0008 [$m^2$])

(2) Bekk smoothness: determined according to JIS P 8119.

(3) Ink receptivity: Printing was performed using an offset rotary press (4 colors) from Toshiba Machine Co., Ltd. with offset printing inks (Vantean Eco from Toyo Ink Mfg. Co., Ltd.) at a printing speed of 500 rpm, and the ink receptivity of the resulting print (solid print in three colors consisting of cyan, magenta and yellow) was visually evaluated according to a 4-class scale: ◎: very good, ○: good, Δ: slightly poor, x: poor.

(4) Ink drying properties: Immediately after printing using an RI press with an offset printing ink (Vantean Eco from Toyo Ink Mfg. Co., Ltd.), the resulting print (solid print in magenta alone) was transferred to a woodfree paper and the cleanness of the woodfree paper was visually evaluated according to the 4-class scale: ◎: very good, ○: good, Δ: slightly poor, x: poor.

(5) Print sharpness: Sharpness of the print in offset printing was visually evaluated by ten panelists according to the 4-class scale: ◎: very good, ○: good, Δ: slightly poor, ×: poor.

(6) Stickiness: Stickiness of the print in offset printing was evaluated by ten panelists according to the 4-class scale: ◎: very good, ○: good, Δ: slightly poor, x: poor.

Example 1

A pigment consisting of 60 parts of fine ground calcium carbonate (FMT-90 from Fimatec Ltd.) and 40 parts of fine clay (JapanGloss from HUBER) was dispersed with a dispersant consisting of sodium polyacrylate in an amount of 0.2 parts based on the pigment in a Cellier mixer to prepare a pigment slurry having a solids content of 70%. Thus obtained pigment slurry was combined with 13 parts of a non-thickening styrene/butadiene latex (glass transition temperature 14° C.), 13 parts of a hydroxyethyl-etherified starch and water to give a coating color having a solids content of 48%. A wood-containing having a basis weight of 46 $g/m^2$ and containing a pulp blend of 25% bleached chemical pulp, 45% mechanical pulp, and 30% deinked pulp with 0.4 parts by weight of an interfiber bonding inhibitor (KB-115 from Kao Corporation) per 100 parts by weight of the pulp was coated on both sides at a coat weight of 5.5 $g/m^2$ per side using a blade coater at a coating speed of 620 m/min and then treated by a 3 roll/single nip supercalender at a linear load determined by the roll weight to give a coated paper.

Example 2

A pigment consisting of 40 parts of coarse-grained ground calcium carbonate (FMT-75 from Fimatec Ltd.) and 60 parts of second grade clay (DB-KOTE from Imerys Minerals Japan K.K.) was dispersed with a dispersant consisting of sodium polyacrylate in an amount of 0.2 parts based on the pigment in a Cellier mixer to prepare a pigment slurry having a solids content of 70%. Thus obtained pigment slurry was combined with 10 parts of a non-thickening styrene/butadiene latex (glass transition temperature 14° C.), 11 parts of a hydroxyethyl-etherified starch and water to give a coating color having a solids content of 54%. A coated paper was obtained by the same procedure as in Example 1 except that a wood-containing having a basis weight of 46 $g/m^2$ and containing a pulp blend of 15% bleached chemical pulp, 45% mechanical pulp, and 40% deinked pulp without interfiber bonding inhibitor was coated at a coat weight of 6.5 $g/m^2$ per side.

Example 3

A pigment consisting of 60 parts of fine-grained ground calcium carbonate (FMT-90 from Fimatec Ltd.), 27 parts of second grade clay (DB-KOTE from Imerys Minerals Japan K.K.) and 13 parts of fine clay (JapanGloss from HUBER) was dispersed with a dispersant consisting of sodium polyacrylate in an amount of 0.2 parts based on the pigment in a Cellier mixer to prepare a pigment slurry having a solids content of 70%. Thus obtained pigment slurry was combined with 20 parts of a non-thickening styrene/butadiene latex (glass transition temperature 14° C.), 5 parts of a hydroxyethyl-etherified starch and water to give a coating color having a solids content of 54%. A wood-containing having a basis weight of 48 $g/m^2$ and containing a pulp blend of 50% bleached chemical pulp, 40% mechanical pulp, and 10% deinked pulp with 5 parts of calcium carbonate as an internal filler and 0.6 parts by weight of an interfiber bonding inhibitor (KB-115 from Kao Corporation) per 100 parts by weight of the pulp was coated on both sides at a coat weight of 5.0 $g/m^2$ per side using a gate roll coater at a coating speed of 620 m/min and then treated by a soft nip calender with 2 nips at a linear load of 18 kg/cm to give a coated paper.

Comparative Example 1

A pigment consisting of 70 parts of first grade clay (DB-Prime from Imerys Minerals Japan K.K.) and 30 parts of fine precipitated calcium carbonate (TP-123 from Okutama Kogyo Co., Ltd.) was dispersed with a dispersant consisting of sodium polyacrylate in an amount of 0.2 parts based on the pigment in a Cellier mixer to prepare a pigment slurry having a solids content of 70%. Thus obtained pigment slurry was combined with 16 parts of a non-thickening styrene/butadiene latex (glass transition temperature 14° C.), 5 parts of a hydroxyethyl-etherified starch and water to give a coating color having a solids content of 50%. A wood-containing having a basis weight of 51 $g/m^2$ was coated on both sides at a coat weight of 2.0 $g/m^2$ per side using a gate roll coater at a coating speed of 1000 m/min and then treated by a soft nip calender with 2 nips at a linear load of 30 kg/cm to give a coated paper.

Comparative Example 2

A coated paper was obtained by the same procedure as in Example 2 except that the adhesives in the pigment slurry were changed to 30 parts of a non-thickening styrene/butadiene latex (glass transition temperature 14° C.) and 20 parts of a hydroxyethyl-etherified starch in Example 2.

Comparative Examples 3

A slightly coated paper having a basis weight of 60.2 $g/m^2$ available from Nippon Paper Group, Inc. "Pyrene Mat DX" was used.

The results are shown in Table 1.

TABLE 1

| | Basis weight ($g/m^2$) | Density ($g/m^3$) | Coat weight ($g/m^2$) | Oil absorbency under pressure ($g/m^2$) | Bekk smoothness (sec) | Ink receptivity | Ink drying properties | Print surface sharpness | Stickiness |
|---|---|---|---|---|---|---|---|---|---|
| Ex. 1 | 56.1 | 0.70 | 5.5 | 56 | 31 | ◎ | ○ | ◎ | ○ |
| Ex. 2 | 61.2 | 0.75 | 6.5 | 41 | 35 | ○ | ○ | ○ | ○ |
| Ex. 3 | 65.4 | 0.63 | 5.0 | 232 | 32 | ○ | ○ | ○ | ◎ |
| Com. ex. 1 | 55.7 | 0.67 | 2.0 | 165 | 49 | Δ | ○ | Δ | ○ |
| Com. ex. 2 | 67.5 | 0.83 | 6.5 | 18 | 64 | ○ | X | ○ | X |
| Com. ex. 3 | 60.2 | 0.89 | 7.5 | 32 | 117 | ◎ | X | ◎ | X |

The invention claimed is:

1. A coated paper for newsprint inks comprising a coating layer containing a pigment and an adhesive on a base paper, characterized in that the coating layer has a coat weight of 4.0 $g/m^2$ or more per side and that the coated paper is smoothed by a calender and has an oil absorbency under pressure of 20 $g/m^2$ or more and a Bekk smoothness of 75 seconds or less, where the oil absorbency under pressure is determined by an amount of soybean oil absorbed at a pressure of 50 kPa for 20 seconds.

2. The coated paper for newsprint inks of claim 1, characterized in that it contains 30 parts by weight or more of calcium carbonate per 100 parts by weight of the pigment.

3. The coated paper for newsprint inks of claim 1, characterized in that it contains an organic compound having the action of inhibiting interfiber bonding of pulp in the base paper.

4. The coated paper for newsprint inks of claim 3, characterized in that the organic compound having the action of inhibiting interfiber bonding of pulp is selected from the group consisting of ester compounds of polyvalent alcohols and fatty acids, fatty acid diamide amines, fatty acid monoamides, and condensation products of polyalkylene polyamine/fatty acid/epichlorohydrin.

5. A process for preparing a coated paper for newsprint inks comprising a coating layer containing a pigment and an adhesive on a base paper and smoothing the coated paper in a calender, characterized in that the coating paper has a coat weight of 4.0 $g/m^2$ or more per side, an oil absorbency under pressure of 20 $g/m^2$ or more and a Bekk smoothness of 75 seconds or less, where the oil absorbency under pressure is determined by an amount of soybean oil absorbed at a pressure of 50 kPa for 20 seconds.

* * * * *